US007624813B2

(12) United States Patent
Ma

(10) Patent No.: US 7,624,813 B2
(45) Date of Patent: Dec. 1, 2009

(54) MOUNT FOR COVERING FIRE SPRINKLER HEAD

(76) Inventor: Kao-Pei Ma, No. 64, Liouyang E. St., Beitun District, Taichung City (TW)

( * ) Notice: Subject to any disclaimer, the term of this patent is extended or adjusted under 35 U.S.C. 154(b) by 127 days.

(21) Appl. No.: 11/849,436

(22) Filed: Sep. 4, 2007

(65) Prior Publication Data

US 2008/0060823 A1 Mar. 13, 2008

(30) Foreign Application Priority Data

Sep. 13, 2006 (TW) ..... 95213172 U

(51) Int. Cl.
*A62C 37/08* (2006.01)
*B05B 15/06* (2006.01)
*B05B 1/00* (2006.01)

(52) U.S. Cl. ..... 169/37; 239/209; 239/600; 239/288.5

(58) Field of Classification Search ..... 169/37, 169/42, 91; 239/208, 209, 288–288.5, 600; 248/345

See application file for complete search history.

(56) References Cited

U.S. PATENT DOCUMENTS 3,389,884 A * 6/1968 Ault ..... 248/345
5,372,203 A * 12/1994 Galaszewski ..... 169/37

* cited by examiner

*Primary Examiner*—Darren W Gorman

(57) ABSTRACT

The fire sprinkler head comprises a water supply pipe including a pipe and a joint coupling to the pipe and forming a connecting end opposite to the pipe; a mount including a cavity formed on the top thereof and adapted to receive the connecting end, a hole defined on the bottom of the cavity, an edge surrounding the hole with a first end and a second end, a recess defined between the first and the second end of the edge and a housing; a nozzle device defining a first end with exterior threads adapted to engage the edge of the mount to the connecting end of the water supply pipe, a second end having an engaging portion and a nozzle, and a hollow; a cover device including a cover, an opening formed in the center of the cover and a plurality of lugs around the opening.

2 Claims, 12 Drawing Sheets

MOUNT FOR COVERING FIRE SPRINKLER HEAD

BACKGROUND OF THE INVENTION

1. Field of the Invention

The present invention relates to a fire sprinkler head and more particular, to a fire sprinkler head is adapted for connecting to the water supply pipe and disposed in concrete of a ceiling via concealed piping.

2. Description of the Related Art

A conventional fire sprinkler head is usually disposed below a ceiling in the building and connects to a water supply pipe. Referring to FIG. 12, a fire sprinkler head 1 is disposed below concrete of a ceiling 3, the fire sprinkler head 1 includes a main body and a cover. The said main body provides for connecting to a water supply pipe 2. The said cover is adapted to install to the main body after the decoration of the building and provided for preventing the dist into the fire sprinkler head 1. However, fire sprinkler head 1 could not be disposed in ceiling so that fire sprinkler head 1 is needed to be disposed below the concrete. Therefore, the fire sprinkler head 1 and the water supply pipe 2 would be exposed from the concrete. A ceiling board 4 is further needed to cover the fire sprinkler head 1 and the water supply pipe 2 for decoration to avoid the whole fire sprinkler head being exposing from the ceiling 3. And the distance between ceiling and floor of a storey 5 would decrease because of the foregoing reason.

SUMMARY OF THE INVENTION

It is, therefore, the purpose of this invention to provide a fire sprinkler head includes a water supply pipe, a mount and a plug connecting the mount to the water supply pipe. The water supply pipe includes a pipe and a joint coupling to the pipe and forming a connecting end engaging to the plug.

The mount includes a cap and a bracket combining with the cap. The cap defines a cavity in the center thereof, a hole formed on the bottom of the cavity, an edge surrounding the hole. The edge is adapted for releasably engaging the connecting end of the water supply pipe with the plug. The bracket includes a housing, a flange formed around the base thereof.

The housing of the mount provides for the plug disposed and concrete could not enter the housing. And the plug is adapted for preventing concrete into the connecting end during the process of grouting.

The fire sprinkler head further includes a nozzle device which could replace the plug after the process of grouting and a cover device coupling to the nozzle device.

The nozzle device forms an engaging end, a nozzle end opposite to the engaging end and a hollow through the engaging end and communicating with the nozzle end. The engaging end has exterior threads for engaging with the edge of the mount and the connecting end of the water supply pipe. The nozzle end includes an engaging portion and a nozzle for watering.

The cover device includes a cover and an opening in the center of the cover device, a plurality of lugs formed on the cover and surrounding the opening. The lugs are adapted for connecting to the nozzle end of the nozzle device.

An advantages of the fire sprinkler head is having a mount to receive a nozzle device for preventing from touching concrete so as the fire sprinkler head could be installed before the process of grouting. The forgoing could simplify the process of construction. Further more, the fire sprinkler head is installed in the ceiling via concealed conduit so that the height of a storey would not decrease and the space of the building would not be occupied.

Other objectives, advantages, and features of the invention will become more apparent from the following detailed description when taken in conjunction with the accompanying drawings.

DETAILED DESCRIPTION OF THE PREFERRED EMBODIMENT

Figure 1:
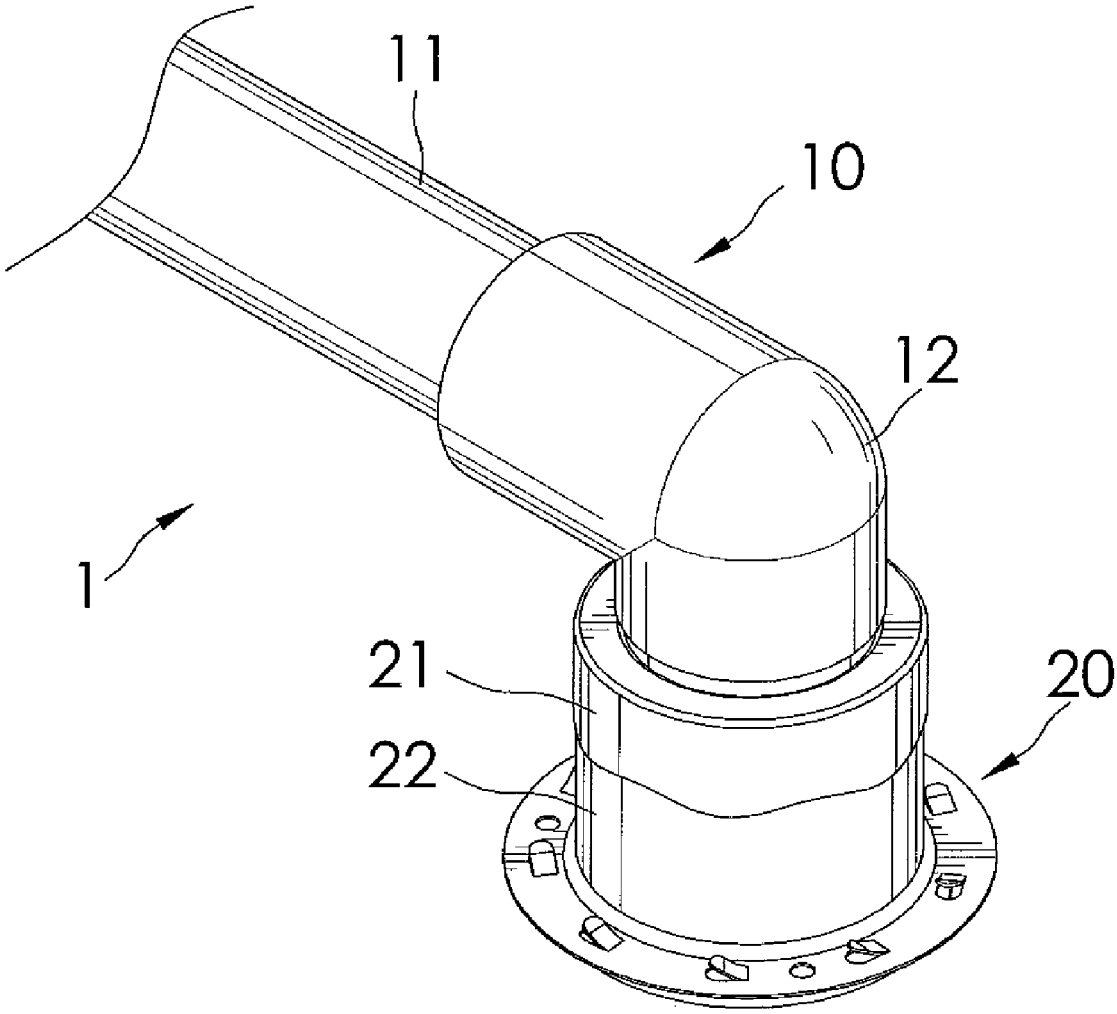
FIG. 1 is a perspective view of a fire sprinkler head in accordance with a first embodiment of the present invention.
Figure 2:
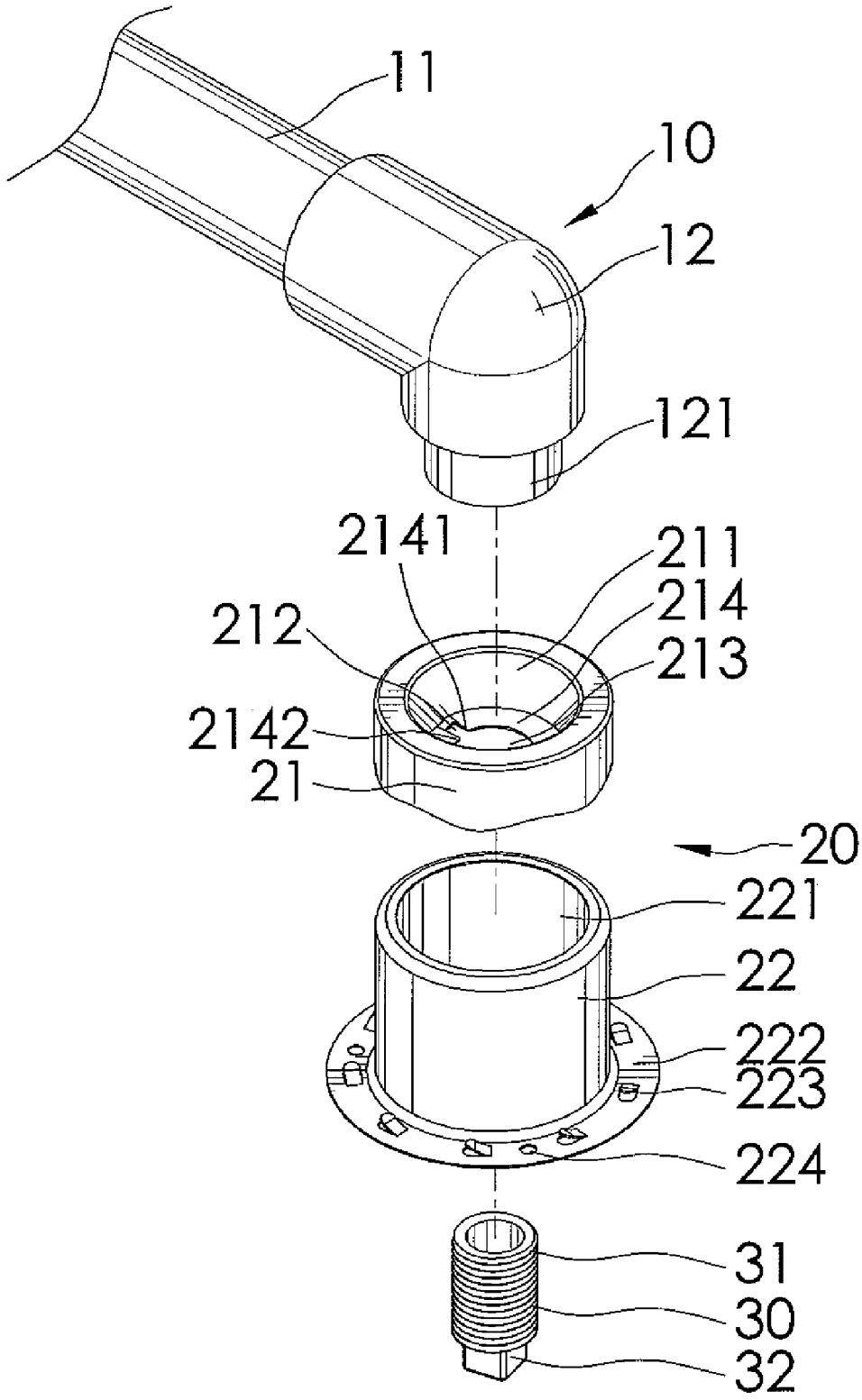
FIG. 2 is an exploded perspective view of FIG. 1, illustrating the fire sprinkler head with a plug.
Figure 3:
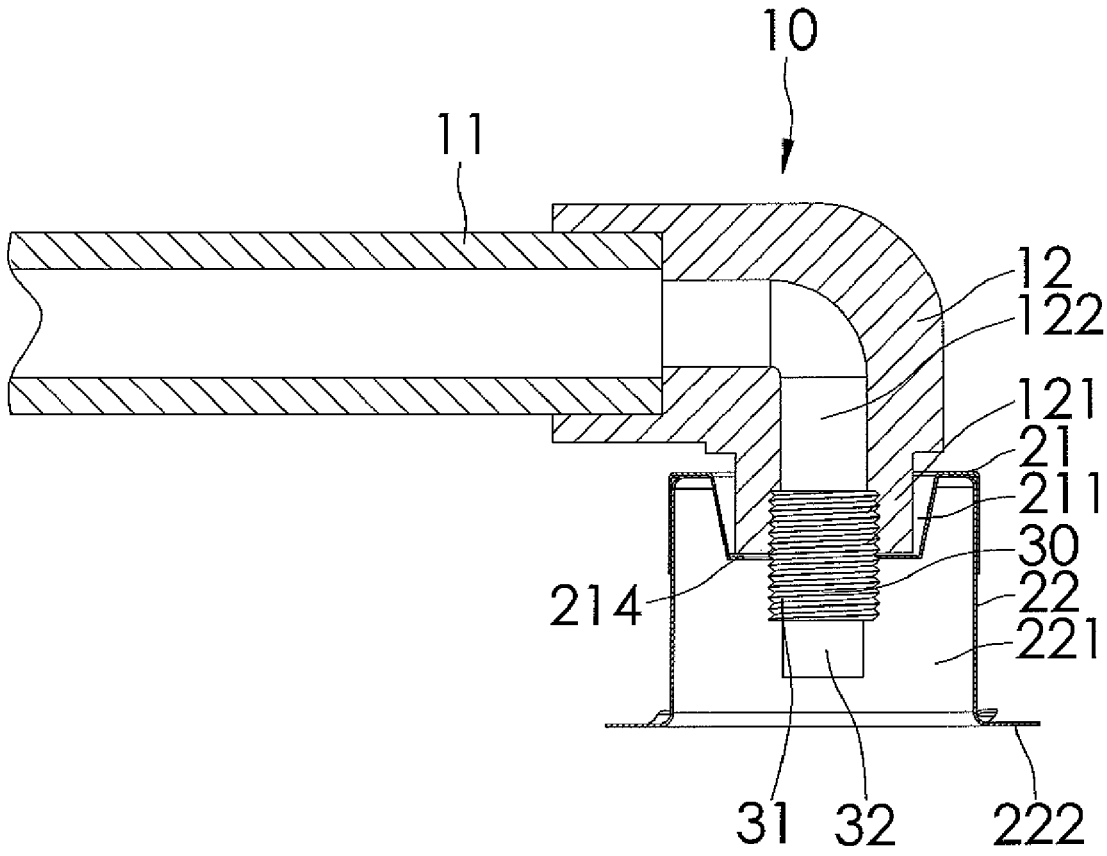
FIG. 3 is a cross-sectional view of FIG. 2.

FIGS. 1 through 3 show a first embodiment in accordance with the present invention, a fire sprinkler head 1 includes a water supply pipe 10, a mount 20 and a plug 30 connecting the mount 20 to the water supply pipe 10. The water supply pipe 10 includes a pipe 11 and a joint 12 coupling to the pipe 11 and forming a connecting end 121 engaging to the plug 30.

The mount 20 includes a cap 21 and a bracket 22 combining with the cap 21. The cap 21 defines a cavity 211 in the center thereof, a hole 213 formed on the bottom of the cavity 211, an edge 214 surrounding the hole 213 and with a first end 2141 and a second end 2142, and a recess 212 defined between the first end 2141 and the second end 2142 of the edge 214. The edge 214 is not even and the height of the first and second ends 2141, 2142 are different so that the edge 214 is easy for other element to engage therewith. The edge 214 is adapted for releasably engaging the connecting end 121 of the water supply pipe 10 with the plug 30. The bracket 22 includes a housing 221, a flange 222 formed around the base thereof, at least one aperture 224 defined on the flange 222 and a plurality of fixed elements 223 formed on the flange 222.

The apertures 224 allow the fire sprinkler head 1 fixed on the formwork in the building before the process of grouting. The fixed elements 223 provide more strength to the mount 20 state in concrete.

The plug 30 includes a first end 31 and a second end 32. The first end 31 of the plug 30 is hollow and has exterior threads.

The second end 32 of the plug 30 is solid. The plug 30 is disposed in the interior of the housing 221 of the bracket 22 and engages with the edge 214 and the connecting end 121 of the water supply pipe 10 via the first end 31 of the plug 30.

Figure 4:
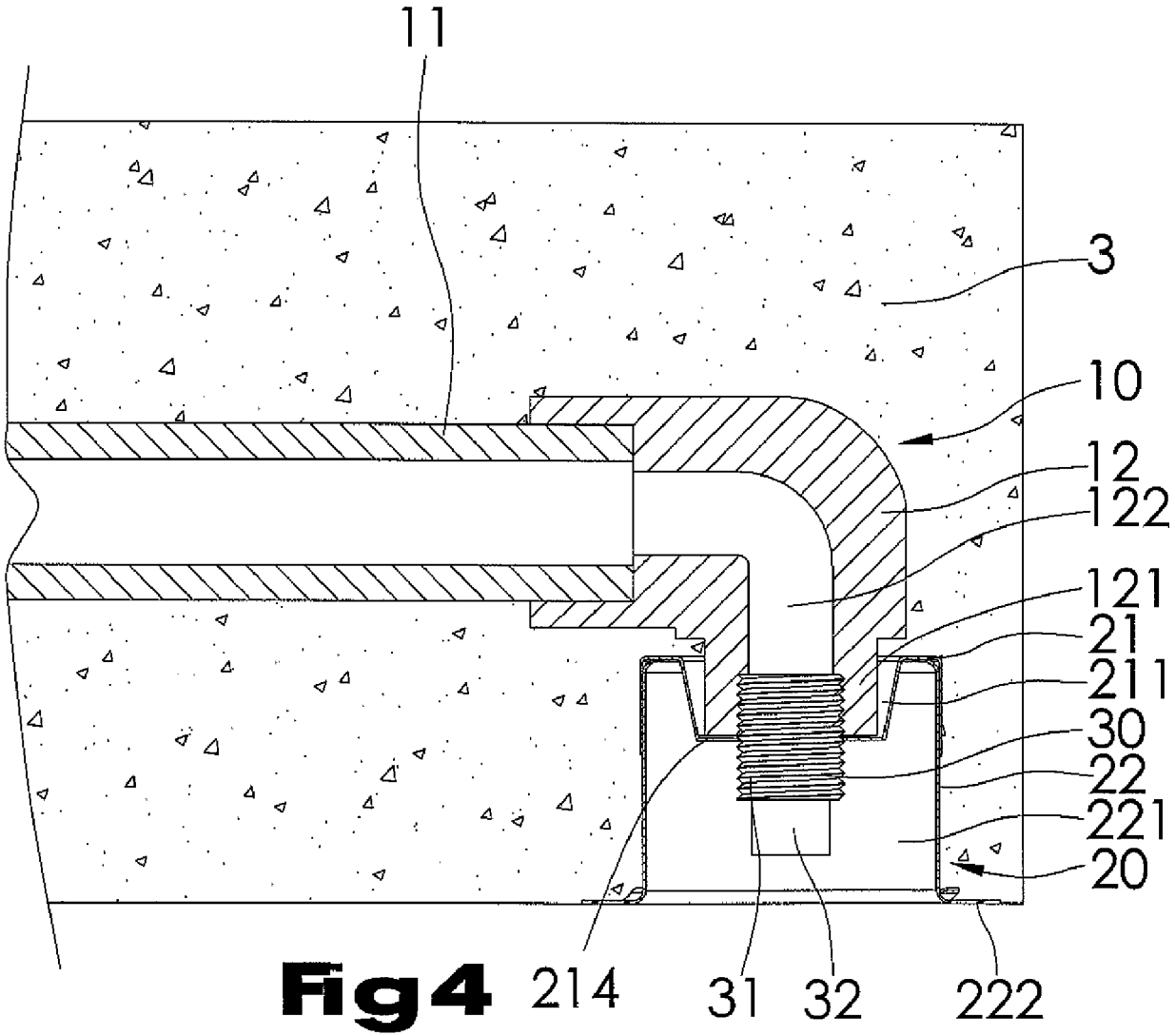
FIG. 4 is a cross-sectional view similar to FIG. 3, illustrating the fire sprinkler head disposed in concrete of a ceiling.

FIG. 4 illustrates that the fire sprinkler head 1 in FIGS. 1 through 3 is disposed in concrete of a ceiling 3. The housing 221 of the mount 20 provides the plug 30 disposed therein and concrete could not enter the housing 221. And the plug 30 is adapted for preventing the connecting end 121 from touching concrete during the process of grouting.

Figure 5:
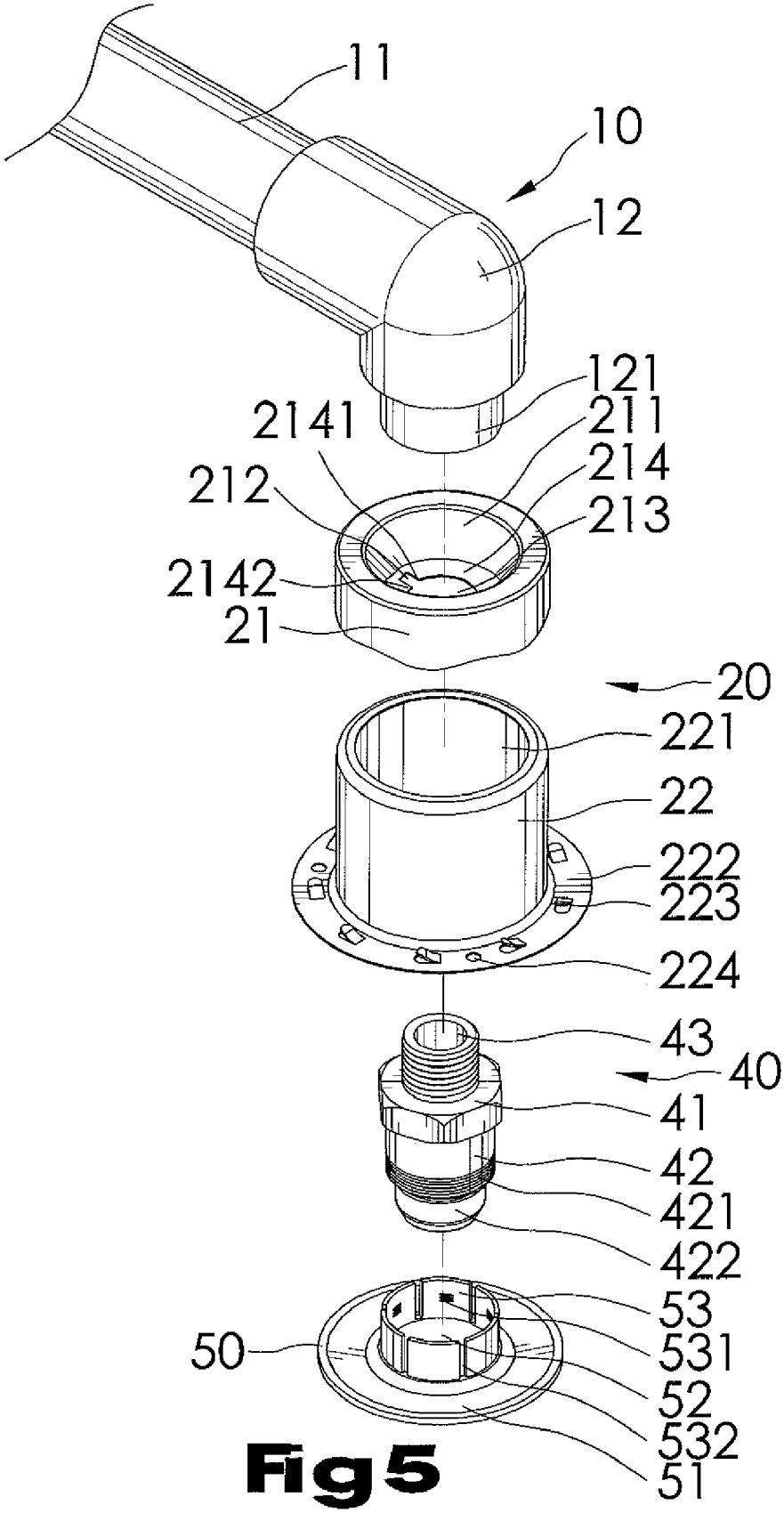
FIG. 5 is an exploded perspective view of FIG. 1, illustrating the fire sprinkler head with a nozzle device and a cover device.

Referring to FIG. 5, the fire sprinkler head 1 further includes a nozzle device 40 which could replace the plug 30 after the process of grouting and a cover device 50 coupling to the nozzle device 40.

The nozzle device 40 forms an engaging end 41, a nozzle end 42 opposite to the engaging end 41 and a hollow 43 through the engaging end 41 and communicating with the nozzle end 42. The engaging end 41 has exterior threads for engaging with the edge 214 of the mount 20 and the connecting end 121 of the water supply pipe 10. The nozzle end 42 includes an engaging portion 421 and a nozzle 422 for watering.

The cover device 50 includes a cover 51 and an opening 52 in the center of the cover device 50, a plurality of lugs 53 formed on the cover 51 and surrounding the opening 52. There's a gap 532 between each two lugs 53 for resiliently mounting on the nozzle end 42. The lugs 53 have at least one slot 531 thereon for engaging with the engaging portion 421 of the nozzle device 40 and the nozzle 422 would protrude through the opening 52 of the cover device 50.

The cover device 50 is preferably made of plastic and is provided for swashing the water from the nozzle device 40. In case of fire it could enlarge the area where water could reach.

Figure 6:
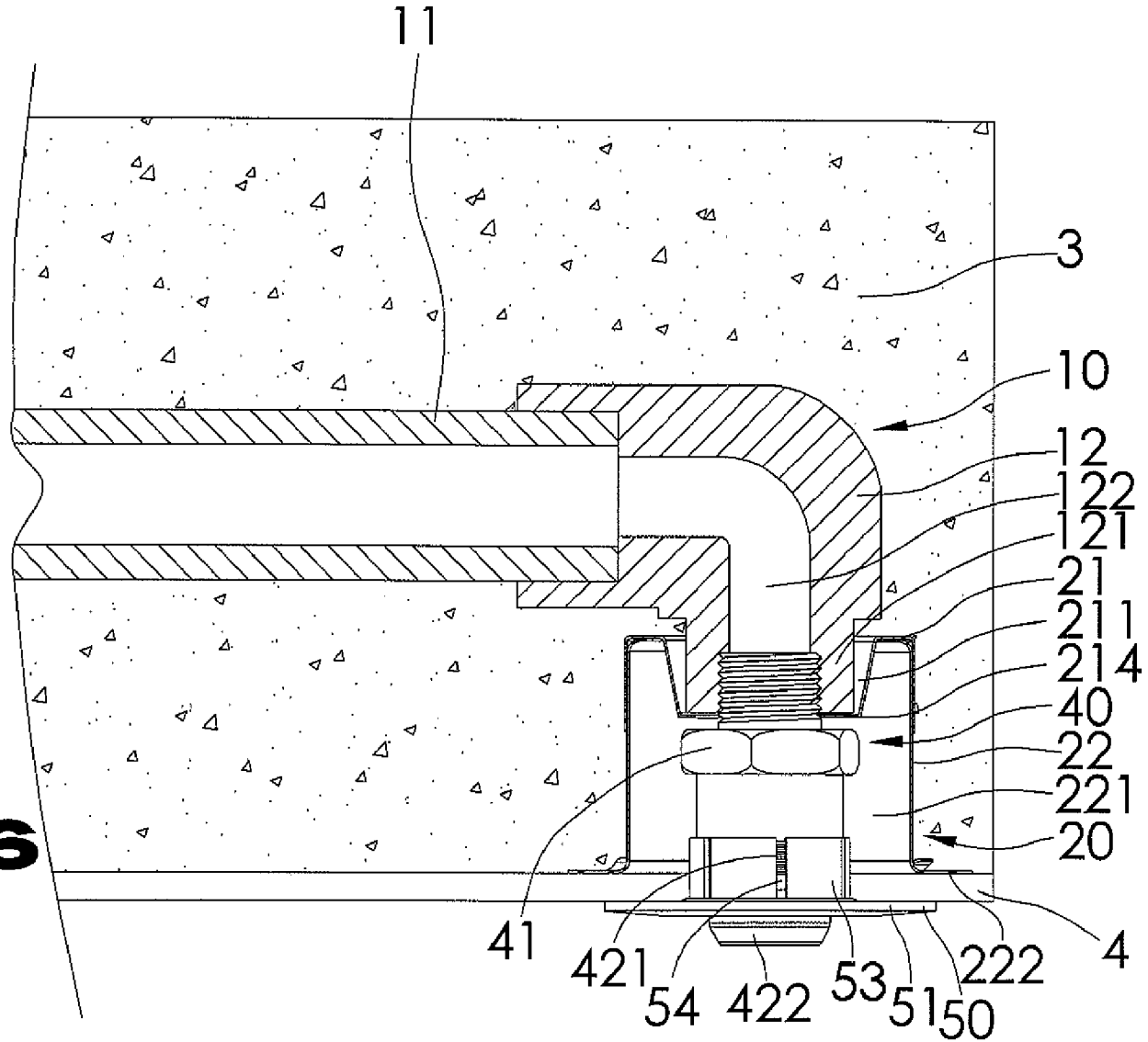
FIG. 6 is a cross-sectional view of FIG. 5.

During the process of grouting, the plug 30 is in advance of location of the nozzle device 40 and adapted for preventing concrete into the connecting end 121 of the water supply pipe 10. Referring to FIG. 6, therefore, after grouting, the nozzle device 40 replaces the plug 30 connecting to the water supply pipe 10 and is disposed in the housing 221 of the mount 20. A formwork 4 installs under the mount 20 and allows the nozzle device 40 protruding there from. The cover device 50 couples to the nozzle end 42 of the nozzle device 40 via the slots 531 and abuts with the formwork 4.

Figure 7:
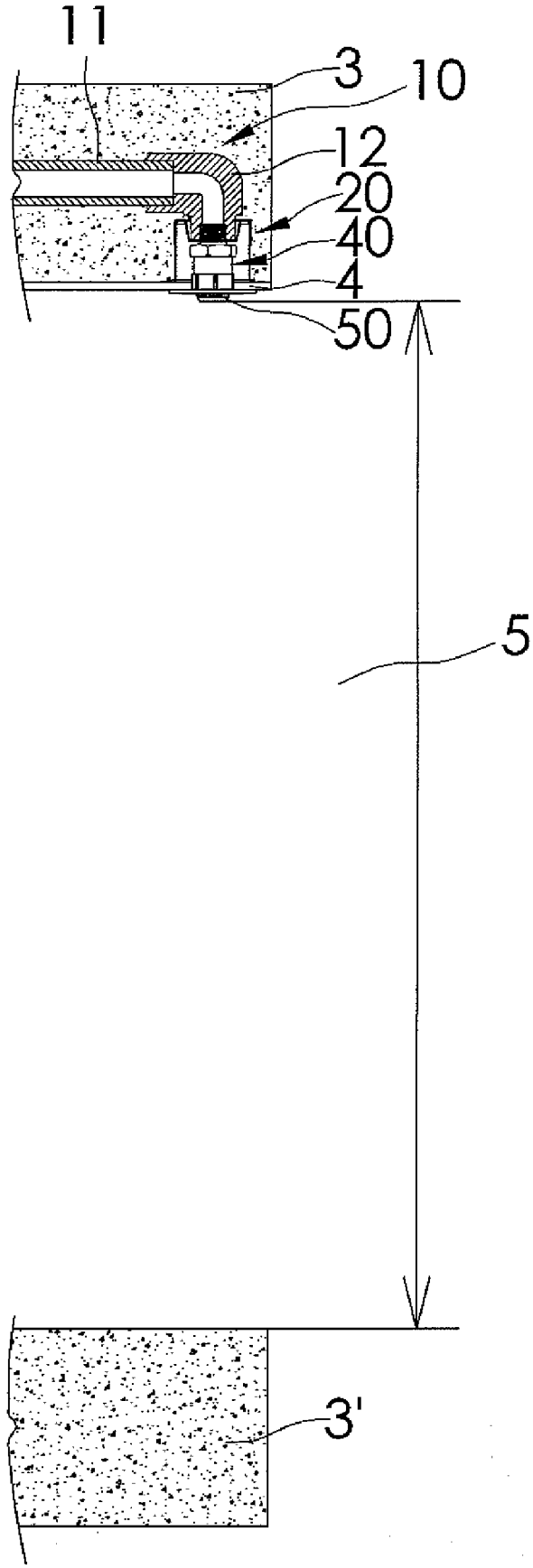
FIG. 7 is a cross-sectional view similar to FIG. 6, illustrating the height between a storey where the fire sprinkler head disposed and another storey.
Figure 8:
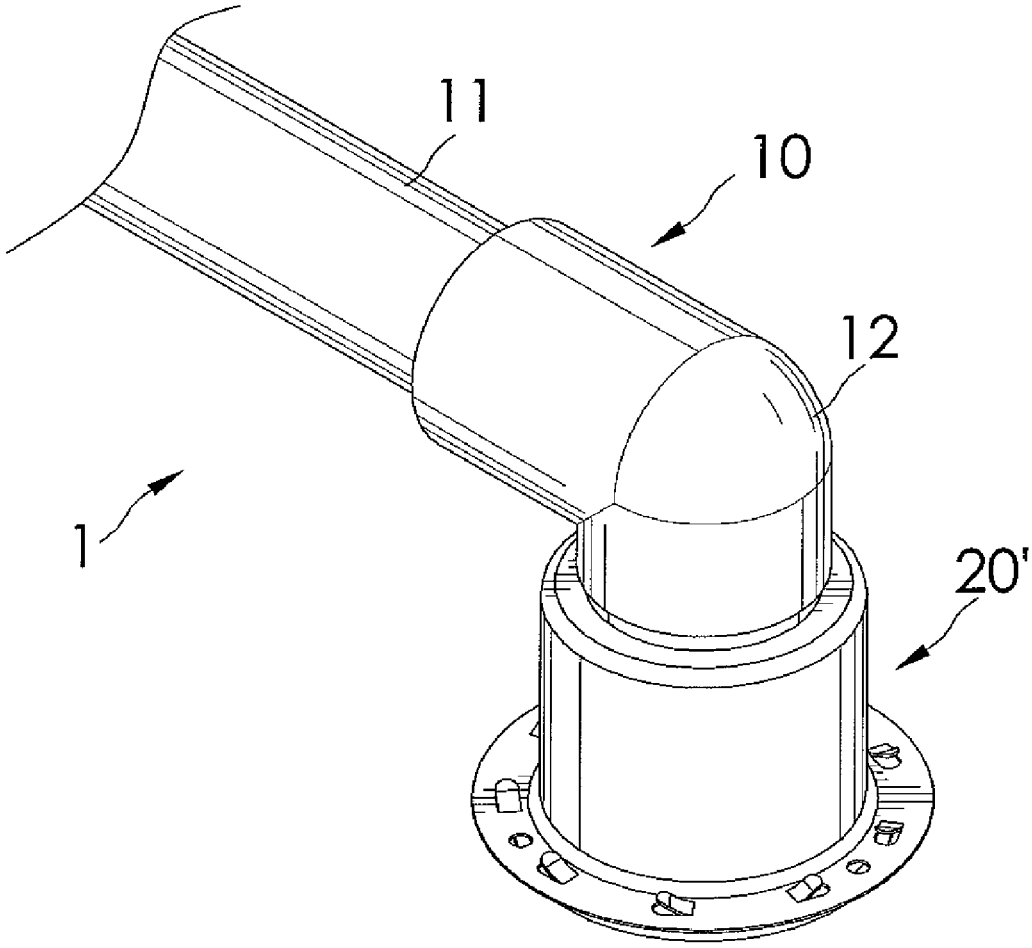
FIG. 8 is a perspective view of a fire sprinkler head in accordance with a second embodiment of the present invention.
Figure 9:
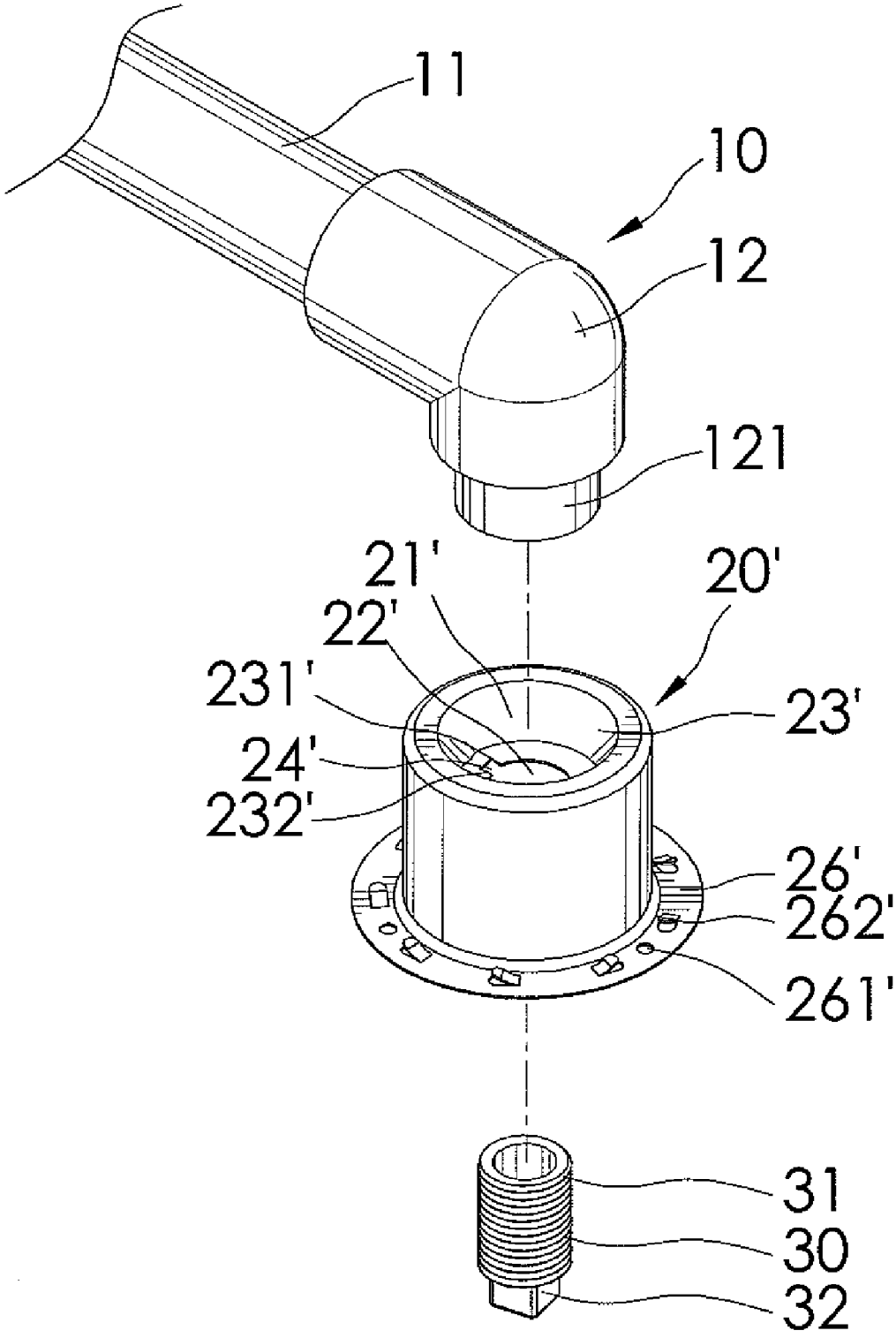
FIG. 9 is an exploded perspective view of FIG. 8, illustrating the fire sprinkler head with a plug.
Figure 10:
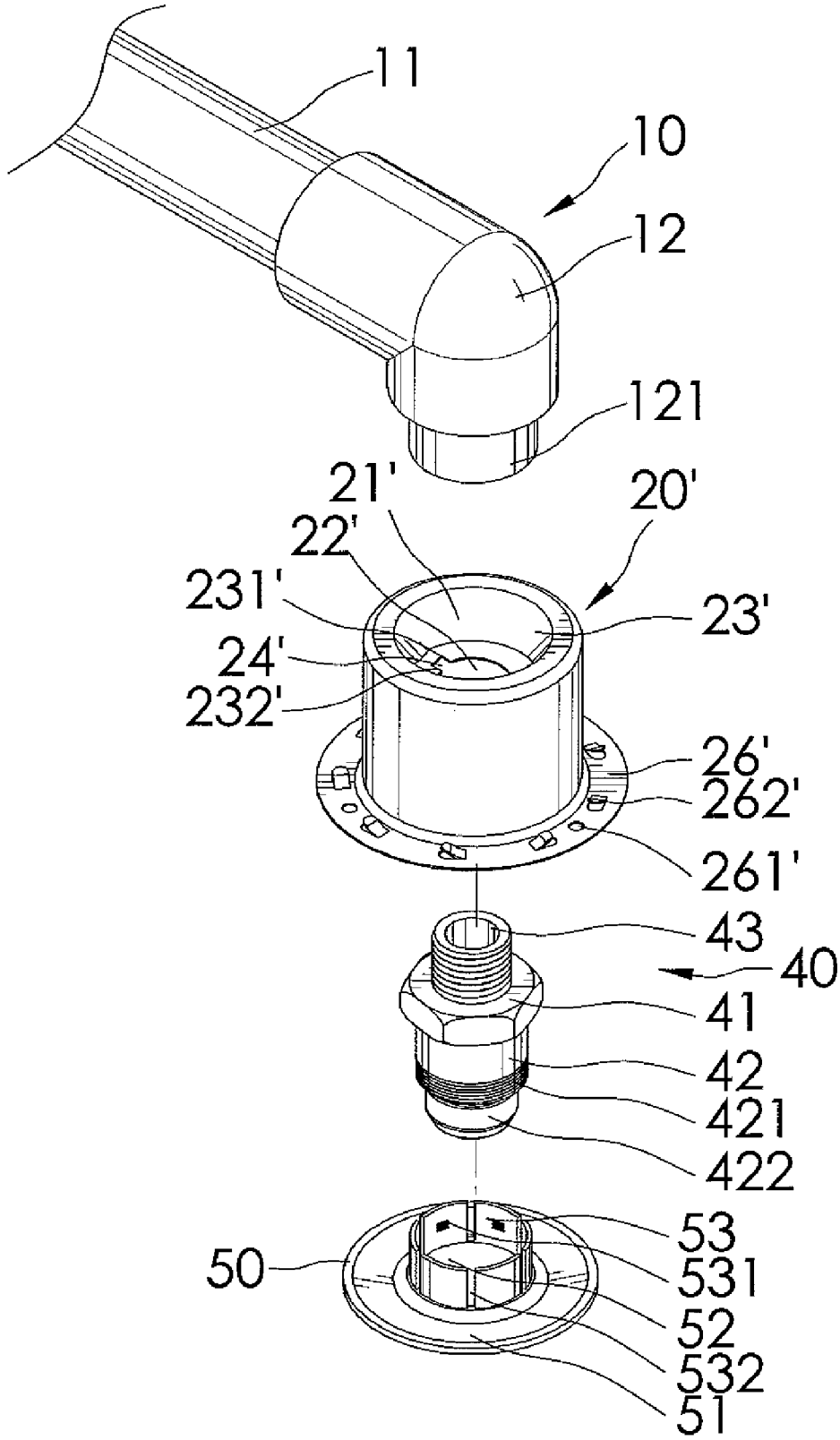
FIG. 10 is an exploded perspective view of FIG. 8, illustrating the fire sprinkler head with a nozzle device and a cover device.
Figure 11:
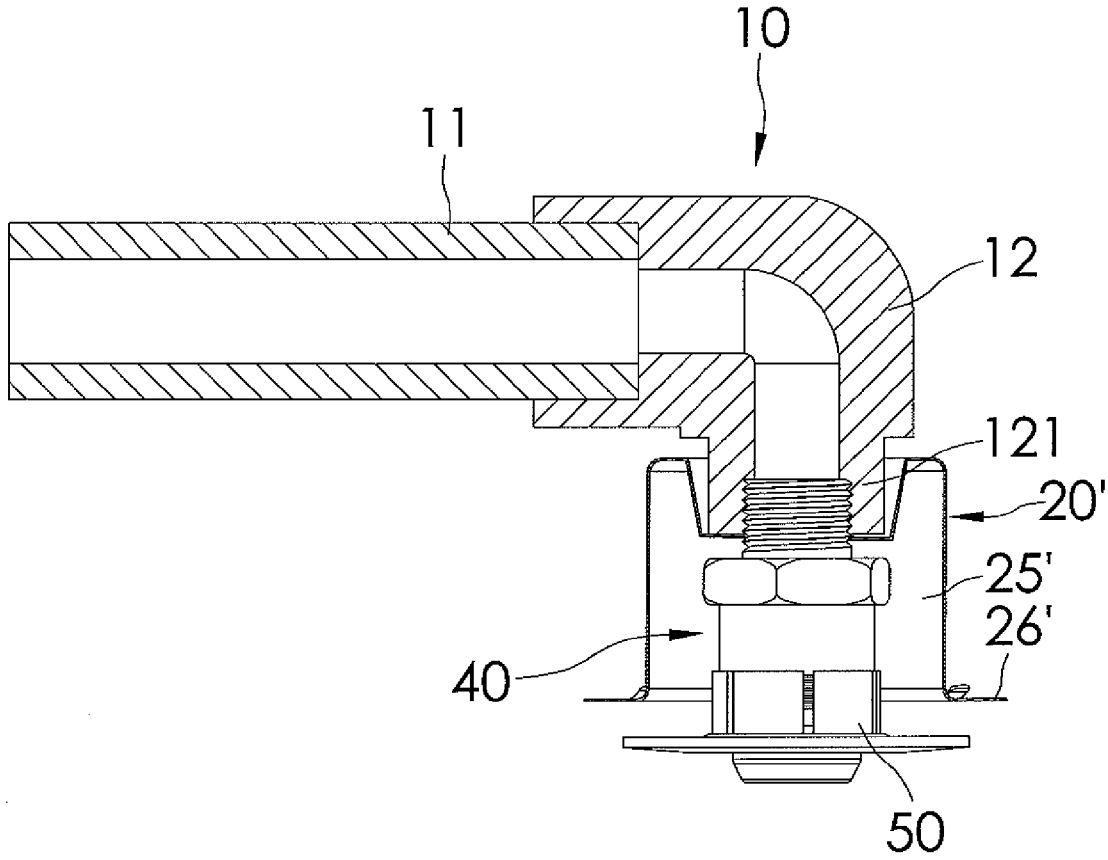
FIG. 11 is a cross-sectional view of FIG. 10.
Figure 12:
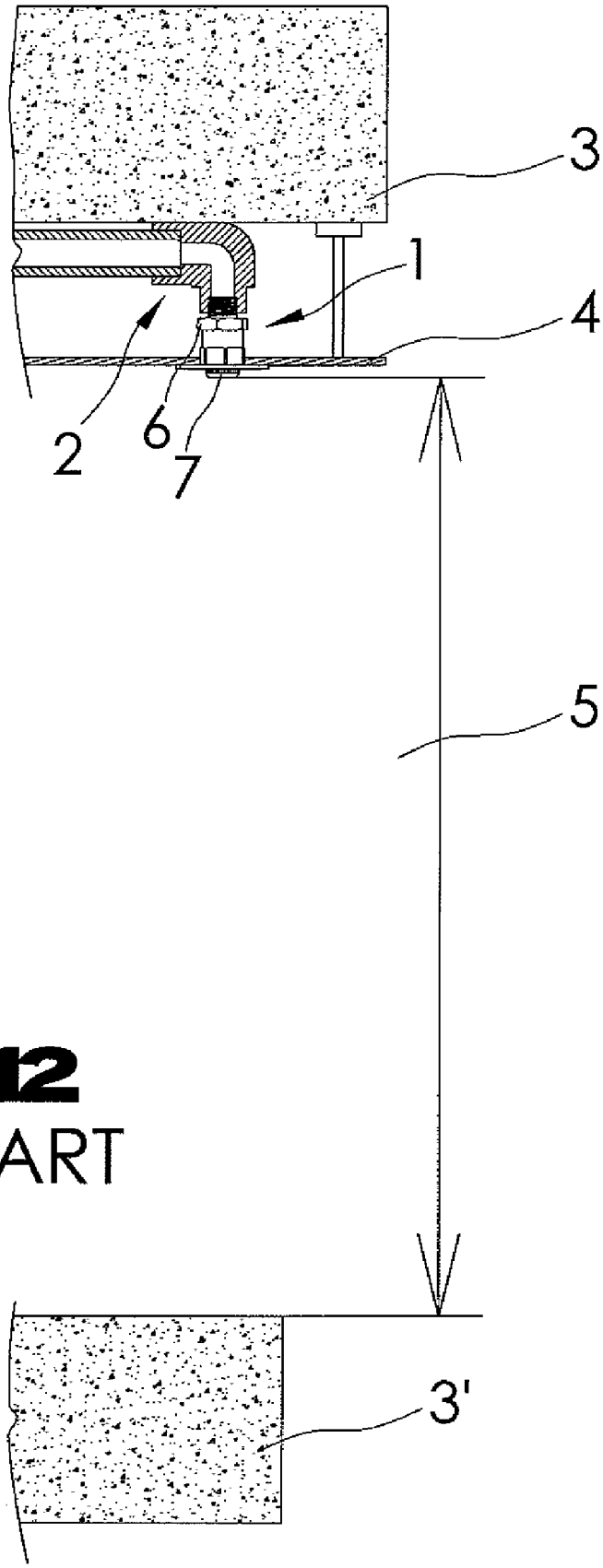
Fig 12 PRIOR ART
FIG. 12 is a cross-sectional view of the height between a storey where a conventional fire sprinkler head disposed and another storey.

FIG. 7 illustrates the height of a storey 5 between another ceiling 3' and the ceiling 3 disposing a fire sprinkler head 1 in accordance with the first embodiment in the present invention. Furthermore, referring to FIG. 12, the height of the storey 5 is higher than the storey in the prior art because that the fire sprinkler head 1 is disposed in concrete of the ceiling 3 and not install below the ceiling.

FIGS. 8 through 11 show a second embodiment in accordance with the present invention similar to the first embodiment with exception that a mount 20' takes place of the mount 20 of the first embodiment.

The mount 20' includes a cavity 21' formed on the top thereof, a hole 22' defined on the bottom of the cavity 21', an edge 23' surrounding the hole 22' with a first end 231' and a second end 232', a recess 24' defined between the first end 231' and the second end 232' of the edge 23', a housing 25' defined below the cavity 21' in the interior thereof, a flange 26' formed around the base thereof, at least one aperture 261' defined on the flange 26' and a plurality of fixed elements 262' formed on the flange 26'.

The apertures 261' provide to allow the fire sprinkler head 1 fixed on the formwork before the process of grouting. The fixed elements 262' provide more strength to the mount 20' state in concrete.

Furthermore, the cavity 21' is adapted to receive the connecting end 121 of the joint 12. The edge 23' is not even and the height of the first and second ends 231', 232' are different so that the edge 23' is easy for other element to engage therewith. The edge 23' is adapted for releasably engaging the connecting end 121 of the water supply pipe 10 with the plug 30 or the nozzle device 40.

Furthermore, the housing 25' is adapted for the plug 30 or the nozzle device 40 disposed therein.

Summarizing the above-mentioned, the advantages of the present invention are:

The fire sprinkler head 1 includes a mount 20 receiving a nozzle device 40 therein and it could prevent the nozzle device 40 from touching concrete. And the fire sprinkler head 1 could be disposed in concrete of the ceiling via concealed conduit so that the fire sprinkler head 1 could install in the ceiling before the process of grouting and it dose not needed extra decoration for covering the exposed fire sprinkler head.

The forgoing allows that the height of storey in the building would not decrease because of the extra decoration and simplify the process of construction.

What is claimed is:

1. A fire sprinkler head comprising:

a hollow mount having a hole at one end;

a nozzle device disposed in the mount and having one end inserted through the hole to secure to a water supply pipe for communicating therewith, the nozzle device including a nozzle at the other end, and an engaging portion between both ends thereof, and a cover device, including a cover, an opening formed in a center of the cover, and a plurality of spaced lugs formed around the opening, wherein the nozzle device extends out of the opening of the cover device to engage the engaging portion of the nozzle device with the lugs.

2. The fire sprinkler head as claimed in claim 1, wherein each of the lugs has at least one slot.

* * * * *